US007146912B2

(12) United States Patent
Hallin et al.

(10) Patent No.: US 7,146,912 B2
(45) Date of Patent: Dec. 12, 2006

(54) FLEXIBLE DETONATOR SYSTEM

(75) Inventors: Sune Hallin, deceased, late of Nora (SE); by Anne-Marie Bokvist, legal representative, Nora (SE); Jan Westberg, Nora (SE); Elof Jönsson, Nora (SE)

(73) Assignee: Dyno Nobel Sweden AB, Nora (SE)

( * ) Notice: Subject to any disclaimer, the term of this patent is extended or adjusted under 35 U.S.C. 154(b) by 0 days.

(21) Appl. No.: 11/027,975

(22) Filed: Jan. 4, 2005

(65) Prior Publication Data

US 2005/0183608 A1 Aug. 25, 2005

Related U.S. Application Data

(62) Division of application No. 10/149,001, filed as application No. PCT/SE00/02439 on Dec. 6, 2000, now Pat. No. 6,837,163.

(30) Foreign Application Priority Data

Dec. 7, 1999 (SE) ..... 9904461

(51) Int. Cl.
*F42C 19/12* (2006.01)
*F23Q 21/00* (2006.01)

(52) U.S. Cl. ..... 102/215; 102/217; 102/276; 102/218; 102/206; 361/249

(58) Field of Classification Search ..... 102/206, 102/215, 217, 218, 264, 276; 361/248, 249
See application file for complete search history.

(56) References Cited

U.S. PATENT DOCUMENTS 4,537,131 A 8/1985 Saunders
4,674,047 A 6/1987 Tyler et al.
4,819,560 A 4/1989 Patz et al.
4,869,171 A * 9/1989 Abouav ..... 102/215
4,986,183 A * 1/1991 Jacob et al. ..... 102/200
5,117,756 A * 6/1992 Goffin, II ..... 102/217
5,214,236 A 5/1993 Murphy et al.
5,295,438 A 3/1994 Hill et al.
5,367,957 A * 11/1994 Hennessey ..... 102/217
5,520,114 A 5/1996 Guimard et al.
5,583,819 A * 12/1996 Roesner et al. ..... 340/10.51
5,602,360 A 2/1997 Sakamoto et al.
5,721,493 A * 2/1998 Paxton ..... 324/502
6,082,265 A * 7/2000 Sakamoto et al. ..... 102/206
6,173,651 B1 * 1/2001 Pathe et al. ..... 102/218
6,604,584 B1 8/2003 Lerche et al.
6,637,339 B1 10/2003 Petzold et al.
6,644,202 B1 * 11/2003 Duniam et al. ..... 102/312
6,837,163 B1 * 1/2005 Hallin et al. ..... 102/215

* cited by examiner

*Primary Examiner*—Michael J. Carone
*Assistant Examiner*—James S. Bergin
(74) *Attorney, Agent, or Firm*—Buchanan Ingersoll & Rooney PC

(57) ABSTRACT

An electronic detonator system includes a control unit, a plurality of electronic detonators and a bus which connects the detonators to the control unit. Each electronic detonator includes a number of flags which may assume either of two possible values, each flag indicating a substrate of the respective detonators. The flags are readable from the control unit by means of digital data packets and the control unit is adapted, by means of these flags, to check the state of the electronic detonator and control the operation of the electronic detonator. When reading the flags, the electronic detonators give responses in the form of analog response pulses on the bus. The detonator system also includes a portable message receiver which on the basis of the flags obtains messages regarding the connecting status of a detonator.

8 Claims, 7 Drawing Sheets

FLEXIBLE DETONATOR SYSTEM

This is a Divisional Patent Application of U.S. patent application Ser. No. 10/149,001, filed Oct. 24, 2002 (now U.S. Pat. No.6,837,163, granted Jan. 4, 2005), which is a 35 U.S.C. § 371 filing of International application No. PCT/SE00/02439, filed Dec. 6, 2000, and claims priority under 35 U.S.C. §119(a)–(d) for the filing of Swedish Application No. 9904461-2, filed Dec. 7,1999.

TECHNICAL FIELD

The present invention generally relates to the firing of explosive charges. More particularly, the invention relates to a flexible, electronic detonator system and associated electronic detonators. The invention also relates to a method for controlling said system.

BACKGROUND ART

Detonators in which delay times, activating signals etc. are controlled electronically, are generally placed in the category electronic detonators. Electronic detonators have several significant advantages over conventional, pyrotechnic detonators. The advantages include, above all, the possibility of changing, or "reprogramming", the delay time of the detonator and allowing shorter and more exact delay times than in conventional, pyrotechnic detonators. Some systems with electronic detonators also allow signalling between the detonators and a control unit.

However, prior-art electronic detonators and electronic detonator systems suffer from certain restrictions and problems.

A detonator system has to be easy and flexible to handle and the risk of misapplication must be reduced to a minimum. At the same time, there is a need for flexible, electronic detonator systems, with a possibility of detailed function and status check and which allow high-resolution and reliable delay times, as well as continuous monitoring of the condition of each detonator. Detonators which are included in such a system should be inexpensive since they necessarily are disposable.

A problem of prior-art electronic detonator systems is that it has often been necessary to weigh up, on the one hand, the functionality of the system in terms of control capabilities and, on the other hand, the cost of a detonator included in the system.

Prior-art electronic detonator systems also have a restriction as regards the preparation of the detonators which has been time-consuming, which means that in practice the number of detonators which could be connected to one and the same system has been limited. The number of detonators in one and the same system has also been limited due to the fact that too high signal levels have been required for communication in a system with many detonators. The more detonators included in the system, the more difficult to communicate with the "last" detonator.

SUMMARY OF THE INVENTION

An object of the present invention is to provide an electronic detonator system which exhibits flexibility, safety and reliability, which results in the restrictions and problems of prior-art technique being essentially obviated, This object aims at providing an electronic detonator system, the "intelligence" of which is found in a reusable control unit, while its detonators preferably have a simple and inexpensive design.

Another object of the invention is to provide a method for controlling a plurality of electronic detonators included in an electronic detonator system, the method being especially suitable for controlling electronic detonators having a simple design.

According to the invention, control is preferably effected by means of a control unit which is connected to an electronic detonator system and is able to send complex signals to a number of electronic detonators in order to check their state and control their function. However, signals which originate from the detonators preferably have the simplest possible form.

The objects stated above are achieved by means of the features which will be evident from the appended claims. The present invention comprises an electronic detonator system, a control unit and an electronic detonator which are included in said detonator system, as well as methods for connecting detonators to the detonator system, for calibrating electronically stored delay times and for communication between a control unit and an electronic detonator.

A knowledge, which forms the basis of the invention, is that the "intelligence" in an electronic detonator system can be located in a central, reusable control unit. Such a control unit preferably comprises a micro-processor, storage media, software, input unit and display unit, and, furthermore, it is advantageously adapted to send complex, digital data packets to connected electronic detonators.

The detonators connected to the control unit are preferably formed completely without the components mentioned above. According to one aspect of the invention, a detonator is provided with electronic circuitry which is adapted to respond to signals (digital data packets etc.) from the control unit. On the other hand, the detonator does not need to contain any microprocessor or software.

It has turned out to be very advantageous that the detonator lacks such parts since a detonator which is too autonomous and has complicated functions may lead to unfortunate malfunction. A detonator having a complex construction also contributes to a higher price of the detonator.

However, in a detonator according to the invention a type of status register is arranged, which indicates various state parameters of the detonator. The status register can be read from the control unit, whereupon information regarding the state of the detonator is transferred to the control unit.

The state parameters of the status register preferably indicate either of two possible values, whereby these state parameters indicate whether a certain condition is present in the detonator. Due to the "binary", or divalent, character of the state parameters, these are often called "flags". A difference in comparison with prior-art technique is thus that these flags are readable from the control unit, instead of just being used by internal electronics in the detonators. This difference is in line with the basic knowledge that the "intelligence" of the system may be located in the control unit, whereby the internal electronics in the detonators can be allowed to be very simple.

At least some of the flags are set on the basis of internal conditions in the electronic detonators, such as the contents of a register or the voltage across a capacitor.

As pointed out above, the deconator does not need to send any data signals or digital data packets to the control unit, but emits instead positive or negative analog response pulses to direct question messages or queries regarding the state of a certain status bit in the status register. It is thus preferred that the detonators only give responses in response to direct queries from the control unit.

A detonator may preferably answer only "yes" or "no" to a direct question in a preferred embodiment, this condition is moved one step further, the detonator giving a positive response by giving a load pulse on the bus which connects the detonator with the control unit, while it gives a negative response by refraining from giving such a load pulse. This may thud be expressed as if a detonator is only able to answer "yes". If the response to a question message is "no", the detonator remains quiet (i.e. gives no pulse on the bus).

Even if it is preferred for a response from a detonator to be given in the form of a load pulse on the bus, any other influence on the bus is possible, the influence being detectable by the control unit. However, it is a central feature of the invention that such influence preferably comprises a non-digital, analog pulse.

Moreover, the control unit may send instructions to the detonators, which do not result in responses being given by the detonators. The purpose of such instructions is, for instance, to transfer a delay time, reset a state parameter or initiate firing of the detonator.

The method according to the invention, comprising the above-mentioned signalling by means of digital data packets, also allows further, advantageous functions. The data format which is used for the data packets is formed in a manner that is unique to this invention. Due to the design of the data format a number of functions are made possible which have not earlier been offered in electronic detonator systems. The design of the data format and the advantages which are thus brought about will be evident from the following detailed description of some preferred embodiments of the invention.

According to one aspect of the invention, each electronic detonator has already been given an identity, or address, in connection with their manufacture. This address is designed so that the detonator, in every practical respect, can be considered as unique. The used data format has been developed in accordance with said detonator address. Thus, each detonator can be addressed individually by means of the data format according to the invention, The addressing, i.e. the used data format according to the invention, is, however, such that the detonators also can be addressed globally, semiglobally or semiindividually. In a preferred embodiment of the invention addressed data packets are thus used globally, or semiindividually, for simultaneous transfer of a question message or an instruction (imperative command) to a plurality of detonators.

In an embodiment of the invention, where the detonators are adapted to give positive responses only, it is preferred that global question messages are of such type that a positive response message is expected only from one or a few of the electronic detonators, whereby the number of analog response pulses on the bus are reduced to a minimum. In order to read, for instance, a state parameter (a flag) in the status register, two complementary questions are thus implemented. A first command asks the question of the type "does the indicated state parameter have the first of two possible values?", while a second command asks the complementary question "does the indicated state parameter have the second of two possible values?".

In spite of the fact that an electronic detonator according to the invention can give only a simple load pulse (an analog response pulse which is detectable by the control unit) on said bus, a very flexible, electronic detonator system is provided, in which a plurality of states in the detonators are readable from a control unit. By means of software in the control unit, the state parameters of the detonators may be used in many different ways. The software of the control unit also controls what instructions and/or questions that are to be sent to the detonators and when these are to be sent.

In a preferred embodiment of the present invention, the control unit of the detonator system is provided with a stable and comparatively exact clock oscillator, whereas each detonator is provided with a simple, internal clock oscillator. The absolute frequency of the internal clock oscillator of the detonators is allowed to vary between the detonators. However, an assumption is that these internal clock oscillators are stable enough, at least during the time that passes between a calibration and an ensuing time measurement, in order to obtain a satisfactory operation.

The clock oscillator of the control unit, in this application often called external oscillator, is used, on the one hand, for controlling when various instructions and/or questions are sent on the bus, and, on the other hand, for calibrating the internal clock of each detonator. As pointed out above, it is desirable that the detonators are made as simple and inexpensive as possible and, therefore, the time accuracy of the system is provided in the reusable control unit. This condition is yet another expression of the "intelligence" of the system being found in reusable parts, instead of in the detonators, which for obvious reasons can be used only once.

From another aspect of the invention, an electronic detonator is provided, in which calibration of the internal clock of the detonator is performed in relation to the accurate, external clock oscillator in the control unit. Calibration of the delay time may be in progress at the same time as regular signalling and other activities are going on in the system. Since the detonators essentially have a relatively simple construction, this calibration is performed by simple counting of external and internal clock pulses from the external and the internal clock oscillators, respectively. The signalling format of the system is formed in such a manner that external calibration pulses may be extracted from the regular signalling of the control unit. Due to the fact that external calibration pulses are extracted from the regular signalling, communication between the control unit and the detonators, and other activities, may be in progress in parallel with the calibration. Thus, the time until the detonators are ready to be fired is minimised.

In order to provide high-definition and exact delay times, calibration is performed in a preferred embodiment during several seconds. Transfer of delay times to detonators that are connected to the control unit may thus take place in parallel with the calibration. This may be a great advantage, for instance, when a very large number of detonators are connected (the system may, for example, allow up to 1000 detonators on the same bus).

In accordance with the invention also an electronic detonator is provided, which comprises electronic circuitry which comprises a number of state parameters (flags) that indicate a number of substrates of the detonator. These state parameters can be read from the control unit of the system by means of digital data packets which are sent from the control unit. Each state parameter indicates either of two possible states. The parameters which indicate the state of the detonator thus have a binary character and, therefore, these state parameters are named "flags", as mentioned above, since they display, by means of flags, a certain state in the detonator. The control unit reads these state parameters by means of question messages which are of the type "yes"/"no" questions.

The detonator also comprises means for giving response messages on the bus, which are preferably given in response to a question message received earlier. Due to the fact that all the question messages are formed so that only a positive ("yes") or a negative ("no") response needs to be given, said response messages may have a very uncomplicated design. In a preferred embodiment, the detonator is adapted to give positive response messages only, while negative responses are indicated indirectly by the detonator refraining from giving any response at all. The response messages are thus given as simple analog load pulses on the bus. The system (the control unit) is not adapted to determine, on the basis of only one response pulse on the bus, whether one or more detonators have given a response pulse at the same time. Nor does the control unit need to determine, based on only a response pulse per se, which of the connected detonators has given the response. The fact is that, in a preferred embodiment of the invention, this cannot be determined because all the detonators answer in the same manner. Since the detonators in a preferred embodiment are adapted to give only one typo of response (i.e. positive "yes" responses in the form of analog load pulses), each question message has preferably also a complementary counterpart.

As pointed out earlier, each state parameter can be read either by a message of the type "does the status bit have the first of two possible values?" or its complement "does the status bit have the second of two possible values?". The question messages may thus be chosen in such a manner that as few responses as possible are expected from the detonators. The way in which the detonators work is closely related to how the control unit interprets response pulses and gives off question messages (and other messages).

Identification of the address of a detonator is carried out by means of the above-mentioned response pulses on the bus. The control unit asks question messages with regard to one address bit at a time and thus reads the address (identity) of the detonator. Preferably, two complementary question messages for each address bit are used, as described above. By the control unit first asking if each bit is a binary one and, subsequently, asking the complementary question regarding the bits for which a positive response was not obtained in the first series of questions, unambiguousness is obtained as regards the identity of the detonator. Finally, a question can be asked with respect to all the registered binary ones of the address of the detonator and a question regarding all the registered binary zeros of the address of the detonator as a definitive control of the address being registered correctly in the control unit.

By means of a bit pointer in the question message from the control unit, one or more address bits may thus be pointed out by one and the same data packet.

It will be appreciated that, depending on the manner in which the detonators answer question messages, identification (i.e. reading of the address) of each detonator has to be carried out in a well-defined way. This will be more evident from the following detailed description of a number of preferred embodiments of the invention. Briefly, the identification is preferably carried out by ensuring that one single detonator at a time answers questions concerning address.

With a view to ensuring that no more than one non-identified detonator is connected to the bus of the system, a portable message receiver is used. When the control unit (logging unit) has finished the identification of a detonator, a message is sent to the portable message receiver that the next detonator can be connected to the bus. The portable message receiver is usually carried by the person who physically connects the detonators to the bus.

In one embodiment of the invention, messages may be sent also from the portable message receiver to the control unit, whereby the control unit (the logging unit) can be given information about possible corrections, such as replacement of a detonator by another one or exclusion of one of the planned detonators.

BRIEF DESCRIPTION OF THE DRAWINGS

The following description of a number of preferred embodiments of the invention will be illustrated in more detail by the accompanying drawings, in which FIG. 1 schematically shows some parts which are included in an electronic detonator system.

DESCRIPTION OF PREFERRED EMBODIMENTS

In the following some preferred embodiments of the invention will be described in more detail.

Figure 1:
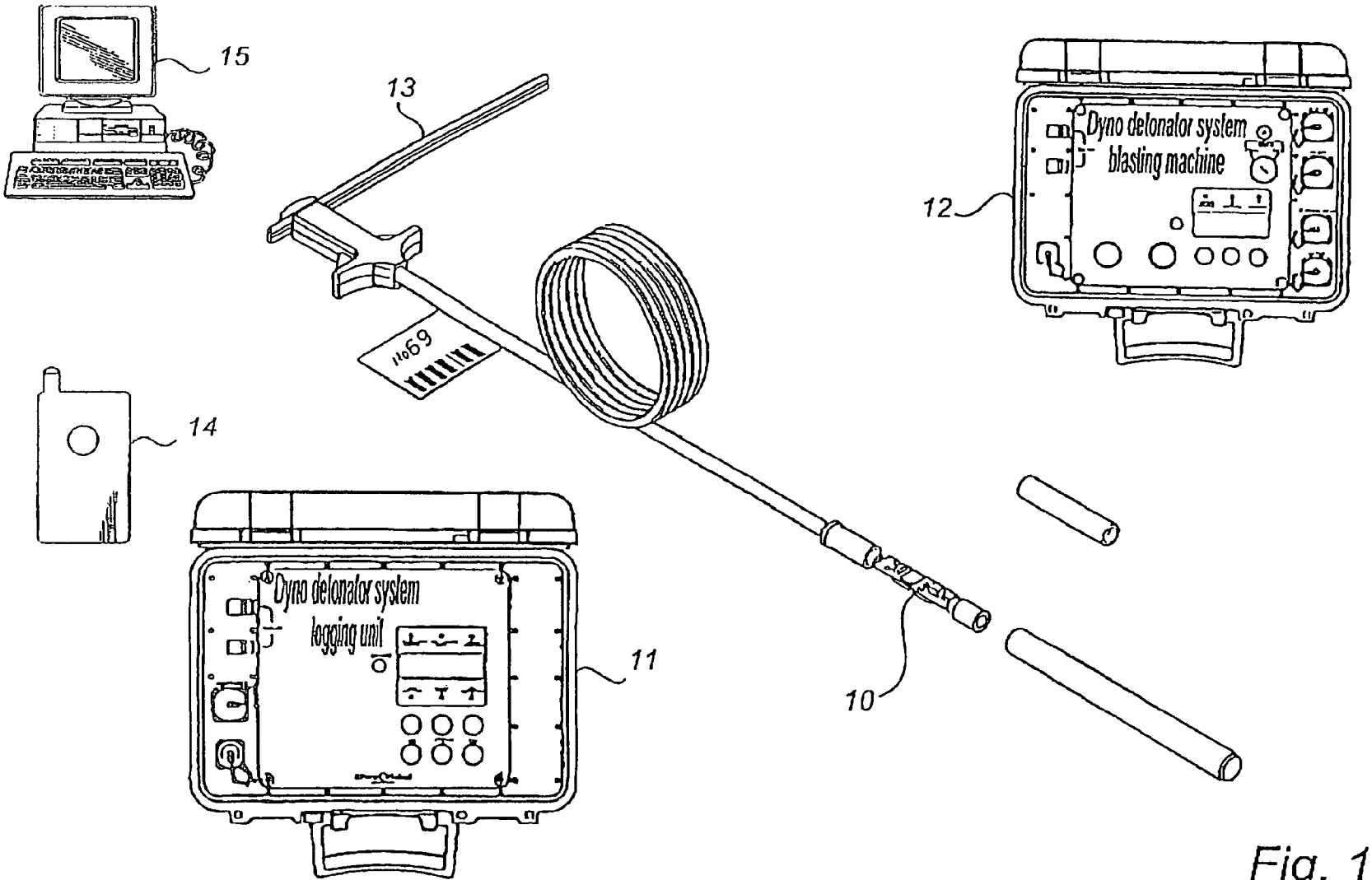

FIG. 1 shows a number of system units which are included in an electronic detonator system. A preferred embodiment of an electronic detonator system according to the invention comprises a plurality of electronic detonators 10 which are connected to a control unit 11, 12 via a bus 13. The purpose of the bus is to convey signals between the control unit 11, 12 and the detonators 10, i.e. to allow communication between them, and to supply power to the detonators. The control unit may comprise either a logging unit 11 (for example when electronic detonators are connected to the bus) or a blasting machine 12 (for instance when connected detonators are being prepared for firing and in connection with firing). Besides, the detonator system according to the invention comprises a portable message receiver 14 which is adapted to be carried by the person connecting the detonators to the bus. Via the portable message receiver la, information is provided about, inter alia, when the system is ready for connection of one more detonator 10. Preferably, a computer 15 is also included in the system, said computer being used to plan the blast. A blasting plan which is prepared in the computer may later be transferred to one of the control units (the logging unit 11 and/or the blasting machine 12).

The control unit, i.e. the logging unit 11 or the blasting machine 12, is adapted to send messages to the detonators 10 via the bus 13. The messages which are sent comprise, in a preferred embodiment, data packets of 64 bits which are supplied in a special data format. This data format allows addressing of a message to a predetermined detonator 10 due to the fact that each detonator has earlier been given an identity (address) which, in every practical respect, is unique. However, the individual detonators 10 have no possibility of sending formatted data packets. Communication from a detonator 10 instead occurs by means of a simple analog response pulse in the form of influence on the bus 13, the influence being detectable by the control unit 11, 12. These response pulses are provided in the preferred embodiment by the detonator 10 increasing its load (impedance) on the bus 13 for a short time. All the detonators 10 answer in the same way, and, thus, it is not possible to determine, only on the basis of the response pulse, which detonator included in the system has given a certain response. The identification of a response, i.e. an analog response pulse on the bus 13 is instead handled by the control unit 11, 12 and is based on what instructions and/or questions have been sent earlier.

As mentioned above, the "intelligence" of the system is thus located in the control unit 11, 12. Although questions may be asked to the detonators 10, the answer to which may be positive ("yes"), as well as negative ("no"), the detonators are adapted to give only one type of response pulses. The system is designed in such a manner that a response pulse is interpreted by the control unit 11, 12 as a positive response ("yes" response), while a negative response simply manifests itself as an absence of a response pulse. By means of smartly formulated question messages from the control unit 11, 12, it is, in spite of the simple communication of the detonators 10, possible to obtain complete information about their state. The response pulse may advantageously be modulated by the internal clock frequency of the detonator 10, or a fraction thereof, with a view to facilitating the detection in the control unit 11, 12, in which case a band-pass filter is used in the control unit.

In a preferred embodiment the response of the detonators is given in a time slot in the form of a response slot between two digital data packets from the control unit. Due to the fact that the response from the detonators is given in said response slot, it is ensured that no other signalling is in progress when the response is to be detected in the control unit. Thus, the detection of the influence of the detonators on the bus is further facilitated, which is advantageous, for instance, when a large number of detonators are connected to the bus. The response from a detonator which is connected to the bus at a large distance from the control unit, would otherwise risk getting drowned in the signals (i.e. digital data packets) of the control unit to the detonators The detonators 10 according to the invention are provided with electronic circuitry which comprises a status register, containing a plurality of state parameters. These state parameters are readable from the control unit by means of the question messages (digital data packets containing a question) mentioned above. Each state parameter indicates one of two possible states, hence the name "flags", since they can be reset between two values as an indication of the state of a parameter of the detonator. Some of these flags are reset from the control unit, while other flags are reset by the detonator itself for indicating predetermined internal parameters. It should be noted that the flag is set only in order to allow reading of the state. A change of a state in a detonator does not lead to any information being obtained in the control unit, but questions from the control unit are necessary in order to transfer information regarding the setting of flags.

In a typical example of an electronic detonator according to the present invention, the detonator is provided with electronic circuitry having a status register, in which a number of status bits (state parameters), or flags, can be set. Each flag corresponds to the state of a certain parameter in the detonator. In a preferred embodiment, the flags below are implemented.

IdAnsFlg: Indicates that the detonator answers questions regarding its identity, i.e. ID logging is activated.

IdRcvFlg: Indicates that the detonator is individually accessed by a valid data packet.

CalEnaF1: Indicates that frequency calibration is allowed.

CalExeF1: Indicates that frequency calibration is in progress.

CalRdyF1: Indicates that at least one frequency calibration is completed.

DelayFlg: Indicates that the detonator has received the same delay time twice in a row.

Arm_Flag: Indicates that the detonator is armed, i.e. charging of the ignition capacitor has begun.

HiVoFlag: Indicates that the detonator, i.e. the ignition capacitor, has reached ignition voltage.

FireFlag: Indicates that the detonator has received the firing command ('FireAl5p').

CaFusErr: Indicates that ignition capacitor or fuse head is missing (or that it has not yet been checked).

ChSumErr: Indicates that an error in a check sum has been detected (at least once).

Err_Flag: Indicates that there is an error, e.g. that an impermissible or incorrect data packet has been received in the detonator.

The flags described above are readable from the control unit which uses the state of these flags for controlling the electronic detonators.

Moreover, the detonators contain a number of registers and counters for storing delay times, correction factors, detonator addresses etc.

Programming of the detonators occurs, in a strict sense, on one occasion only, that is when each chip is given a "unique" identity. This programming occurs when manufacturing the chip. The identity of the chip comprises, in the preferred embodiment, a 30-bit binary address, whereby $2^{30}$=1 073 741 824 different addresses are possible. Thus, in each practical respect, the identity of the chip may be considered "unique" or at least "pseudo-unique" due to the great number of possible addresses. After the identity programming of the chip, no high voltage will be applied to the chip until. Dust before firing, it is time to charge an ignition capacitor. According to an embodiment of the address coding, i.e. the identity of the chip, four of the available thirty bits are used for identification of the manufacturer, or factory, which has made the chip. Thus, each manufacturer has the use of $2^{26}$=67 108 864 different addresses, whereby this number of chips can be manufactured before an address (identity) has to be used a second time. Besides, it is preferred that these twenty-six bits are divided into, for instance, on the one hand, "Batch #"+"Wafer #" (14 bits) and, on the other hand, "Chip #" on the wafer (12 bits) at issue. By using twelve address bits per wafer, $2^{12}$=4 096 chips with different identities may be manufactured from the same wafer. Furthermore, it is preferred that each identity represents a predetermined position on the wafer, whereby a good traceability is obtained for each chip. If it later turns out that a chip is impaired by a manufacturing defect, its position on the original wafer can thus be traced and, consequently, adjacent chips on the wafer may be identified for carrying out a supplementary functional test.

An end user can thus start from the assumption that all the chips (i.e. electronic detonators) which he or she uses has unique identities. However, the control units of the electronic detonator system are adapted to detect two similar identities which, after all, could happen to be connected to the same bus.

The electronic detonator system according to the present invention allows very flexible and exact delay times in the respective detonators. It is thus preferred that each detonator has a stable and reliable clock (oscillator). In the following, a method will be described which is used for calibrating the internal delay time in the different electronic detonators in order to obtain a detonator system having exact delay times in accordance with the invention.

The internal clock (oscillator) in each chip is not adapted to be exact as regards absolute value, but is instead designed to be stable. Regarding the internal clock in detonators on one and the same bus, the highest clock frequency is, as a matter of fact, allowed to differ, for instance, by a factor of two from the lowest clock frequency. Moreover, these internal frequencies are not known to the control units (logging unit and blasting machine) of the system. Accuracy in the system is achieved by means of an external clock frequency in, for example, the blasting machine. Nominally, this frequency is 4 kHz in a preferred embodiment of the invention. In order to synchronise the delay times of the detonators, all the detonators use the same reference which is represented by the external clock frequency. A preferred method for calibrating the delay times will now be described.

The delay time is transferred to a detonator in a general format, for example binary coded with sixteen bits. In a preferred embodiment of the invention, the delay time for a predetermined detonator is between 0 and 16 000 ms and has a resolution of 0.25 ms. The delay time is stored in a register ('DelayReg') which comprises a so-called Flip-Flop. In order to make said delay time useful in the chip, it is necessary that the delay time be converted to a corresponding number of internal clock cycles. This conversion is carried out by multiplication of the stored delay time by an internal correction factor ('CorrFact'), which is calculated in the calibration method. Usually, the correction factor is given a default value which is used in case the calibration method for some reason should not occur or fail. Suitably, this default value is chosen to correspond to an internal clock frequency, which is close to the expectation value of the different clock frequencies, for example, at the arithmetical average value of the clock frequencies allowed in the system.

The calibration method is initiated by the flag 'CalEnaF1' being set from the control unit. When this flag is set, the detonator is allowed to start calibration according to the following.

External clock cycles are counted in a first internal counter and internal clock cycles are counted in a second internal counter. Before the actual calibration is initiated, the chip of the detonator waits for the counter of the external clock to count up to its maximum value and, subsequently, restart from zero. At the same time as the counter of the external clock restarts from zero, the actual calibration is initiated, provided that the flag 'CalEnaF1' mentioned above is set. A predetermined number of external clock cycles is counted in the first internal counter ('ExtClCnt') at the same time as the number of internal clock cycles is counted in the second internal counter ('IntClCnt'). A calibration in progress is indicated by the calibration flag ('CalExeF1') being set to "1". The ratio between the number of counted internal clock cycles and the number of external clock cycles counted during the same time, now results in calibration of the internal clock found in each electronic detonator. The stored delay time (in the register 'DelayReg') thus obtains an accurate and unambiguous correspondence in a certain number of internal clock cycles. As soon as the calibration has been completed, the flag is set which indicates completed calibration ('CalRdyF1'), whereby it is indicated that at least one calibration round is carried out. At the same time 'CalExeF1' is automatically reset to '0' for indicating that calibration is no longer in progress.

The calibration method described above will now be described in more detail. The delay time of a predetermined electronic detonator is transferred to, and is stored in, a register in said detonator. The delay time is stored in sixteen bits in a binary form with the interval 0.25 ms. In this illustrative example, the delay time is set completely arbitrarily and exclusively by way of example to 1392.5 ms, which, in a binary form and with the time interval 0.25 ms, corresponds to [0001 0101 1100 0010]. In this example, the correction factor is originally Hex 0F0000, which is the correct correction factor of an internal clock having the frequency 60 kHz. Suppose now that the true internal clock frequency actually is 56 kHz. In order to obtain a correct correction factor, compensation has to occur in accordance with the internal clock frequency. For this purpose, a predetermined number of external clock pulses is counted from the control unit in the first counter ('ExtClCnt') at the same time as internal clock pulses are counted in the second counter ('IntClCnt'). The ratio between the contents in these two counters thus corresponds to the ratio between the internal and the external clock frequency. If the external clock frequency is assumed to be nominally 4 kHz and 10,000 pulses are counted at said frequency (i.e. counting during 2.5 s), at the same time 140,000 pulses will be counted at the internal clock frequency (which in this example has been assumed to be 56 kHz). The ratio between the internal and the external clock frequency is thus 140,000/10,000=14. If the internal clock frequency had been 60 kHz, 150,000 pulses would have been counted during the same time, in which case the ratio between the internal and the external clock frequency would have been 15. The ratio between the internal and the external clock frequency corresponds to the correction factor. When the delay time which is stored in the general time format is multiplied by the correction factor, however, an automatic truncation occurs of the sixteen least significant bits, the correction factor which corresponds to the frequency ratio 15 (Bin [1111]) becoming Bin [1111 0000 0000 0000 0000]=Hex0F0000. In an analogous manner, the new correction factor for the frequency ratio 14 becomes Hex 0E0000. By means of multiplication of the stored delay time by the correction factor, the number of internal clock cycles is thus obtained which corresponds to the intended delay time. The choice of numerical values and the choice of calculation method above have been made with the aim of, in an intelligible way, explaining how the calibration is carried out in the respective electronic detonators.

Yet another advantage of the calibration method described above is that calibration may be in progress at the same time as other signalling is in progress between the control unit and the electronic detonators since the counting of the number of external and internal clock pulses, respectively, occurs locally in each detonator. Thus, it is not necessary to wait for the calibration to be completed before sending other instructions or questions to the electronic detonators. Due to the fact that the calibration is carried out by means of counting clock pulses, without any specific time interval limiting the calibration, the above-mentioned response slots between data packets sent from the control unit may be used without interfering with the calibration.

No special signals are sent from the control unit for transferring the external clock pulses. The external clock pulses are transferred to the detonators by means of the regular data packets. Due to the fact that the data bits in the digital data packets are arranged in accordance with the external clock oscillator, external clock pulses can be read (extracted) from these regular data packets. More particularly, one of the bits of the data packets functions as a control bit for each individual detonator when it is to extract the external clock pulses.

A preferred data format for transferring information from a control unit to a detonator will now be described. It is preferred that the data format comprises 8 bytes with 8 bits in each byte. Byte number 1 comprises initiating bits, a start bit and a control word (a command). The instructions and questions which are implemented in a preferred embodiment of the present invention will be described in the following. Byte numbers 2–5 indicate the address of the detonator or detonators, to which the information is to be sent. Byte numbers 6–7 comprise data bits which generally contains arguments to the instructions and questions mentioned above. Byte number 8 contains a check sum and stop bits.

With the above division of the chip identity of the detonator into manufacturer (factory), batch, wafer and chip number, a typical data packet may be as follows:

| | | |
|---|---|---|
| Byte | #1 | 0 0 0 1 C T R L |
| | #2 | g i C O D E a a |
| | #3 | a a a a a a a a |
| | #4 | a a a a A A A A |
| | #5 | A A A A A A A A |
| | #6 | D D D D D D D D |
| | #7 | d d d d d d d d |
| | #8 | C H K S U M 0 0 |

The data packet begins with three zeros, the chip in the detonator determining what signalling frequency represents binary "0" (and, thus, indirectly what represents binary "1"), independently of connection polarity. At the same time a coarse calibration of the ratio between the internal and the external clock frequency is carried out, the ratio later being used when interpreting data packets. Subsequently, the actual start bit (Byte #1, Bit #4) follows, which initiates the information part of the data packet. The last four bits in byte number 1, [C T R L], (Byte #1, Bit #4–#8) contain the control word (command), which will be described in more detail in the following. Byte numbers 2–5 contain the address of the current detonator. The first two bits [g i] (Byte #2, Bit #1–#2) indicate to what extent the address is to be interpreted as a global address or as an individual address. Four different levels are thus possible: Global addressing, in which all the subsequent address bits are ignored; two degrees of semiindividual addressing, in which only some of the subsequent address bits (for example the finishing eight and the finishing twelve bits; respectively) are used in the addressing, and individual addressing, in which all the subsequent address bits are used in the addressing. Subsequently, the thirty-bit address (Byte #2, Bit #3–#8+Byte #3–#5) follows, which begins with a "producer code" [C O D E] (Byte #2, Bit #3–#6). Then fourteen bits follow, which indicate the batch and wafer of the manufacture, and twelve bits, which indicate the number or location of the chip, on the wafer. This division of the address into fourteen plus twelve bits is preferred, but, of course, also the thirty address bits according to another disposition can be used. In byte numbers six and seven, sixteen data bits follow. They comprise the argument that belongs to the command (i.e. the command which is specified in Byte #1, Bit #5–#8) of the data packet. Finally, in byte number eight a six-bit check sum and two stop bits follow. The check sum is calculated on the basis of 53 bits, that is from the start bit (Byte #1, Bit #4) to the last data bit, i.e. Byte #7, Bit #8.

The data packets are sent by the control unit according to the principle "FM0-modulation" which uses frequency shift keying (PSK) with polarity changes. The fundamental communication frequency is 4 kHz. A row of "zeros" comprise a signal at 4 kHz and a row of "ones" comprise a signal at 2 kHz. A bit with the value '0' takes up an entire period at 4 kHz, while a bit with the value '1' takes up half a period at 2 kHz. The bit length is thus 250 μs. A polarity change after 125 μs is interpreted by the electronic detonators as if the bit were a "zero", and lack of such polarity change is interpreted by the electronic detonators as if the bit were a "one".

The bit length is thus 250 μs, because of which a 64 bit data packet takes up 16 ms. After each data packet a 5 ms time slot follows in the form of the response slot, in which the detonators answer question messages. The total time of a data packet, including the response slot, is thus 21 ms.

Since the reading of the addresses of the electronic detonators for obvious reasons cannot be carried but by means of individually addressed question messages, a method with global addressing of such question messages is used for reading the addresses (the address identification). In a preferred embodiment of the invention, the addresses of the electronic detonators are read by the logging unit when the detonators are connected to the bus of the detonator system. During the phase when the detonators are connected to the bus, the logging unit continuously sends activation instructions which, as they are received by a detonator, places the latter in a response state, in which the detonator answers questions regarding its identity (address). As soon as a detonator has answered such an activation command, the logging unit stops sending these instructions and starts reading the address information. When the identification (i.e. the reading of the address of the detonator) is finished, the flag ('IdRcvFlg') is set, which indicates that identification of this detonator is completed. When the flag 'IdRcvFlg' is set, the detonator does not respond to the activation instructions mentioned above. It is preferred, but not necessary, that the detonator is put in a power saving state when the identification is completed. In an embodiment of the invention, the detonator is put in a power saving state by means of an individually addressed command ('IdPwrDwn') from the control unit (the logging unit). For this command to have effect, it is required that the intended detonator has-both 'IdRcvFlg' and 'IdAnsFlg' set, with the purpose of avoiding that detonators are unintentionally put in power saving state. When the entire identification process is completed and the detonator is possibly put in power saving state, the logging unit starts sending activation instructions again, while waiting for the next detonator to respond, which may already be connected to the bus.

Figure 2A:
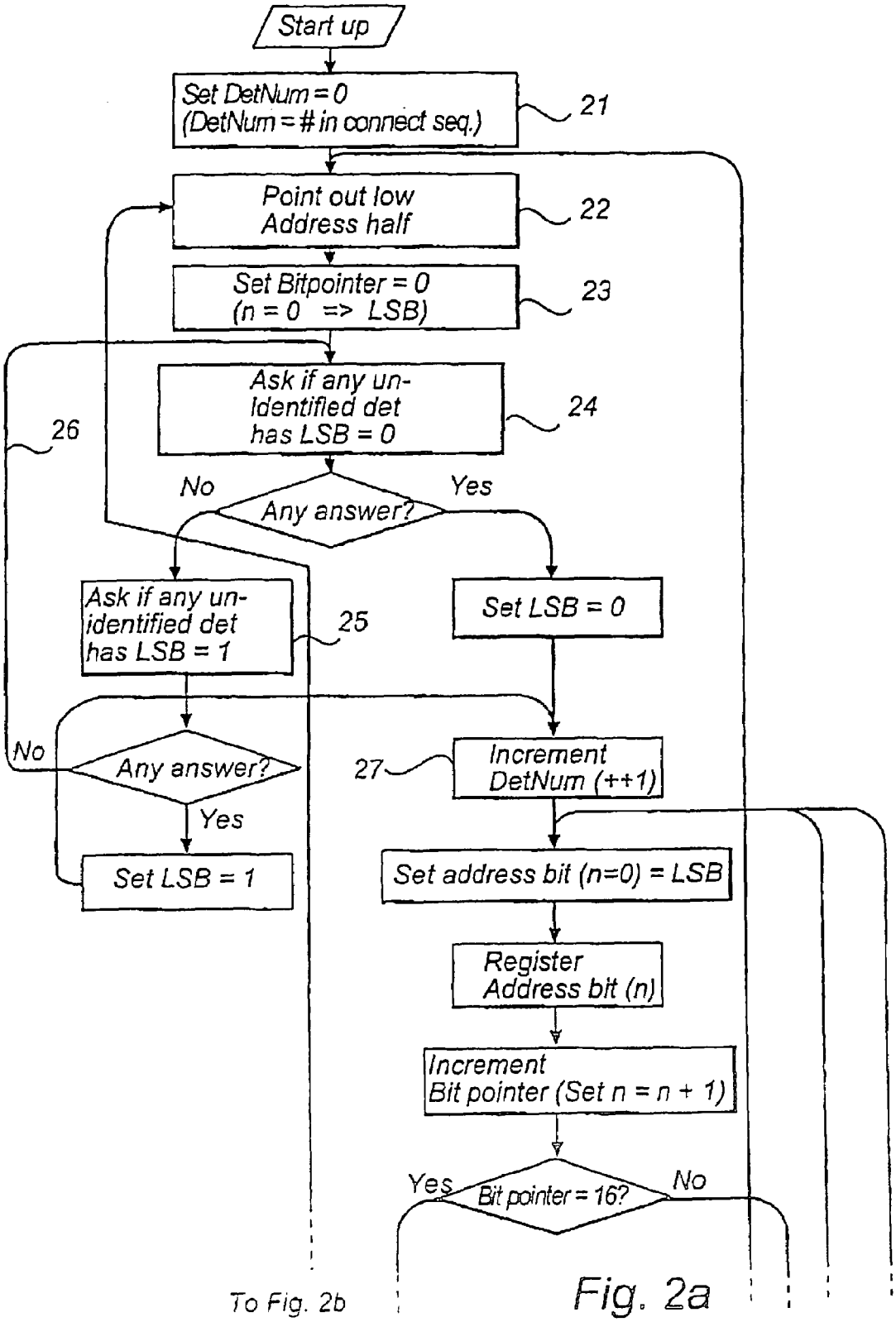
FIGS. 2*a* and 2*b* are schematic flow charts of the activities passed through by the logging unit when connecting detonators to the bus of the electronic detonator system.
Figure 2B:
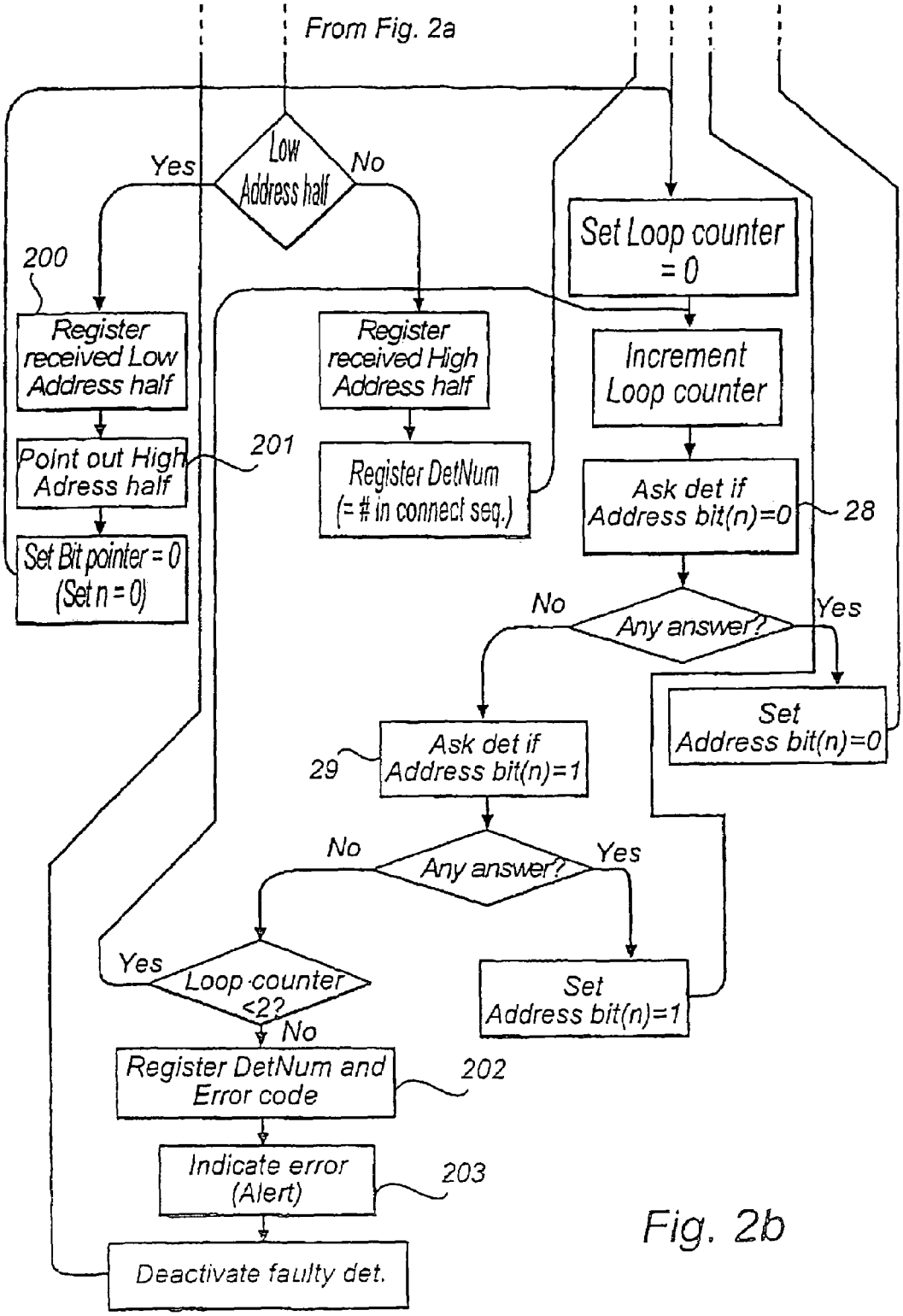

FIGS. 2*a* and 2*b* show a schematic flow chart of the activities passed through by the control unit, in this case the logging unit, when connecting detonators to the bus.

When the logging-unit is started, a pointer 'DetNum' to an address table is reset 21. In this table a sequence of addresses is indicated together with the corresponding number of the detonator at issue in the connecting sequence subsequently, the low address half of the address field is pointed out 22 as an indication to the effect that this address half is to be read. Remember that the address field is thirty bits, while the bit pointer of the data packet is only sixteen bits, resulting in the division into a low and a high address half, respectively. When this is completed, the activation command, as mentioned above, starts being sent from the logging unit. As a matter of fact, this activation command comprises a question regarding the least significant bit (LSB) of the address field 23. During this stage, a question whether LSB is "0" is asked 24, as well as whether LSs is "1" 25. In the embodiment which is shown in FIGS. 1*a* and 1*b*, it is first asked whether LSB is "0". If no response is obtained in the logging unit to this question, the complementary question is asked, that is whether LSB is "1". If no response is obtained even now, this is interpreted as if no new detonator has been connected to the bus, and the procedure is repeated 26. When a response to any of the above-mentioned questions is obtained, the corresponding address bit value in the address table of the logging unit is observed and the pointer 'DetNum' is incremented 27. The corresponding questions regarding the next address bit etc. are subsequently asked 28, 29 until the bit pointer points at the address bit number 16. The reading of the address bits in the low address half is thus completed 200, after which the high address half is pointed out 201 and the above-mentioned questions regarding the high address half are repeated correspondingly. For all the address bits except for the first one, it will be appreciated that there is an error, if a response is obtained neither to the question whether the address bit pointed out is "1" nor whether the address bit pointed out is "0". Once a detonator is connected to the bus, one of the two complementary questions 28, 29 regarding the value of an address bit must give a response pulse on the bus (i.e. a positive response). In the case no response is obtained to any of these questions, the number of the detonator and the corresponding error code are noted 202. It is preferred that the error is also indicated 203 on the portable message receiver, the person connecting the detonators to the bus being given the possibility of correcting the error, for example by checking the connection or changing the defective detonator.

When the identification of a detonator is completed, a message is sent to the portable message receiver, the person connecting the detonators to the bus being told that the next detonator may be connected to the bus. The portable message receiver may also receive a confirmation that the latest detonator has been correctly connected. If no information about correct connection of a detonator is received in the portable message receiver, said detonator may manually be substituted by another detonator or, alternatively, the connection may be checked once again.

The object of the portable message receiver is thus that the person connecting the detonators to the bus should be told, on the one hand, whether the connection per se is correct and, on the other hand, whether the detonator responds to the messages of the control unit in a correct manner. The use of the portable message receiver will consequently increase the reliability of the connection since it will easily be appreciated which detonator causes potential problems. Such detonator may thus be disconnected and replaced by another detonator or be disconnected and reconnected.

Another object of the portable message receiver is to let the person connecting the detonators to the bus know when the next detonator may be connected with a view to avoiding that here are, on one and the same occasion, more than one detonator which can respond to question messages regarding identity. As soon as a recently connected detonator has responded to an activation command from the control unit (logging unit), the control unit stops sending such activation commands. The next detonator may, as a matter of fact, thus be connected to the bus as soon as the identification of the detonator that has been connected earlier has started.

In the following a number of commands, as they are implemented in an embodiment of the invention, will be described. A command (control word) is indicated in the control bits [C T R L] (Byte #1, Bit #5–#8) of the data packets. These four bits can thus indicate up to sixteen different commands. Of these sixteen possible commands in the preferred embodiment, six commands comprise questions, one command a 'NOP' command [C T R L]=[1 1 1 1] (a null) and one command a firing command [C T R L]=[0 0 0 0]. The remaining eight commands are instructions to the detonators.

However, the firing command ('FireAl5p') differs from all the other commands. In principle, the firing command comprises a data packet which consists of zeros only. The firing command is thus an entire data packet which has no start bit, no check sum (i.e. [C H K S U M]=[0 0 0 0 0 0]), no explicit address and no data bits. The condition for a data packet to be interpreted as a firing command is that during 64 consecutive bits, two ones at a maximum have been received. The number of ones in a data packet are counted via three separate two bit counters, the interpretation being carried out by majority resolution, i.e. in order to interpret the data packet as a firing command, two of these three two bit counters must show two ones at a maximum in is one and the same data packet.

As described above, the thirty address bits in each address of a detonator are divided into two groups. One group with the most significant bits and one group with the least significant bits. Thus, a bit pointer of sixteen bits may be used for reading the entire thirty bit address. In order to read the addresses of the detonators, four different queries (questions) are thus implemented, 'RdLoAdr0' "Does each address bit, pointed out by the bit pointer, of the group with the least significant bits of the address equal a binary zero?", 'RdLoAdr1' "Does each address bit, pointed out by the bit pointer, of the group with the least significant bits of the address equal a binary one?", 'RdHiAdr0' "Does each address bit, pointed out by the pointer, of the group with the most significant bits of the address equal a binary zero?", and 'RdHiAdr1' "Does each address bit, pointed out by the bit pointer, of the group with the most significant bits of the address equal a binary one?".

Even if each address bit can only assume the value zero or one, the question commands mentioned above are thus formed as mutually complementary pairs. The reason for this is, as emphasised above, that the detonators are formed to give only analog response pulses on the bus, which give a positive response.

Apart from these four question commands which relate to the address bits of the detonators, yet another two question commands are implemented in the preferred embodiment. These two questions serve to read the status register in the electronic circuit device of the detonator, the status register maintaining state parameters (flags) mentioned above. In a manner similar to that mentioned earlier, these two question commands comprise each other's complement and have the following interpretation:

'EcRegBi0' "Does each state parameter pointed out by the bit pointer equal a binary zero?", and 'RdRegBi1' "Does each state parameter pointed out by the bit pointer equal a binary one?".

The bit pointer comprises the argument of the question command, i.e. the data bits of the digital data packet. In most cases, these question commands will be used with the bit pointer (the argument of the question command) pointing out only one bit in the status and address register, only one of the data bits of the data packet being a one. However, in certain cases it may be desirable that a greater number of bits are pointed out by the bit pointer (i.e. several of the data bits of the data packet are a one), for example when a final check is carried out that all the address bits have been perceived correctly by the control unit or when several flags are to be read at the same time. The response from a detonator will then be positive if and only if all the bits pointed out correspond to the question, i.e. the response comprises a logic AND operation between the bits pointed out. In the preferred embodiment, this example is used for a final check of predetermined flags in the detonator before firing.

Other commands being instructions (imperative commands) which do not lead to the detonators sending any response pulse will be described in the following.

'IdPwrDwn' "Put addressed detonators in a power saving state!". A detonator is put in a power saving state by the internal clock oscillator being shut off. Even if it is possible to send a global or a semiindividual order which puts all, or a group of, connected detonators in an electricity saving position, this command is preferably individually addressed. The argument of this command (i.e. the data bits of the data packet) has no actual function, but in order not to interpret by mistake ocher commands as 'IdPwrDwn', it is preferred that a special appearance of the data bits is required.

'Reset' "Reset all the flags and state parameters to the same state as after start up!". This command may be globally, as well as individually, addressed.

'StopAsw' "Stop answering questions regarding identity!". When this command is received in a detonator, the detonator stops answering the question messages which are asked in connection with reading of the address of the detonator. In the preferred embodiment, this command is implemented as a global command.

'NulRegBi' "Set each register bit pointed out by the bit pointer to zero!". The command may be global, as well as individual. The argument comprises the bit pointer of the state parameters which are intended to be set to zero. Setting to zero means that the corresponding status bit is given the value zero.

'SetRegBi' "Set each register bit pointed out by the bit pointer to one!". The command may be global, as well as individual. The argument comprises the bit pointer of the state parameters which are intended to be set to one. Setting to one means that the corresponding status bit is given the value one.

'StoreDly' "Store the delay time in DelayReg if the same delay time has been received once before, otherwise set 'Err_Flag'!". This command is preferably individually addressed. The argument comprises a sixteen bit representation of the intended delay time with a resolution of 0.25 ms.

'Arm' "Arm the detonator!". Arming of the detonator is carried out by the short circuiting of an arming transistor being released and the charging of the ignition capacitor being allowed. This command is in the preferred embodiment always a globally addressed command. The argument of this command has no actual function, but in order not to misinterpret by mistake any other command as an arming command, usually an argument of a predetermined appearance is required. It should be noted that the 'Arm' command per se does not lead to the flag 'Arm_Flag' being set. This flag is instead set in response to the ignition capacitor having started charging, i.e. the voltage across the capacitor is higher than a predetermined value. However, it is possible also to let. 'Arm_Flag' be set by an 'Arm' command, as well as by the voltage across the ignition capacitor having increased. Thus, it may be checked that the 'Arm' command has been perceived correctly by the detonators even before voltage has started building up in the ignition capacitor, while a set 'Arm_Flag' without a preceding 'Arm' command still gives an indication that something is wrong in the detonator. Similar functionality is possible also for other flags.

Several of the flags described earlier are also set in response to predetermined internal conditions in the detonator.

Figure 3A:
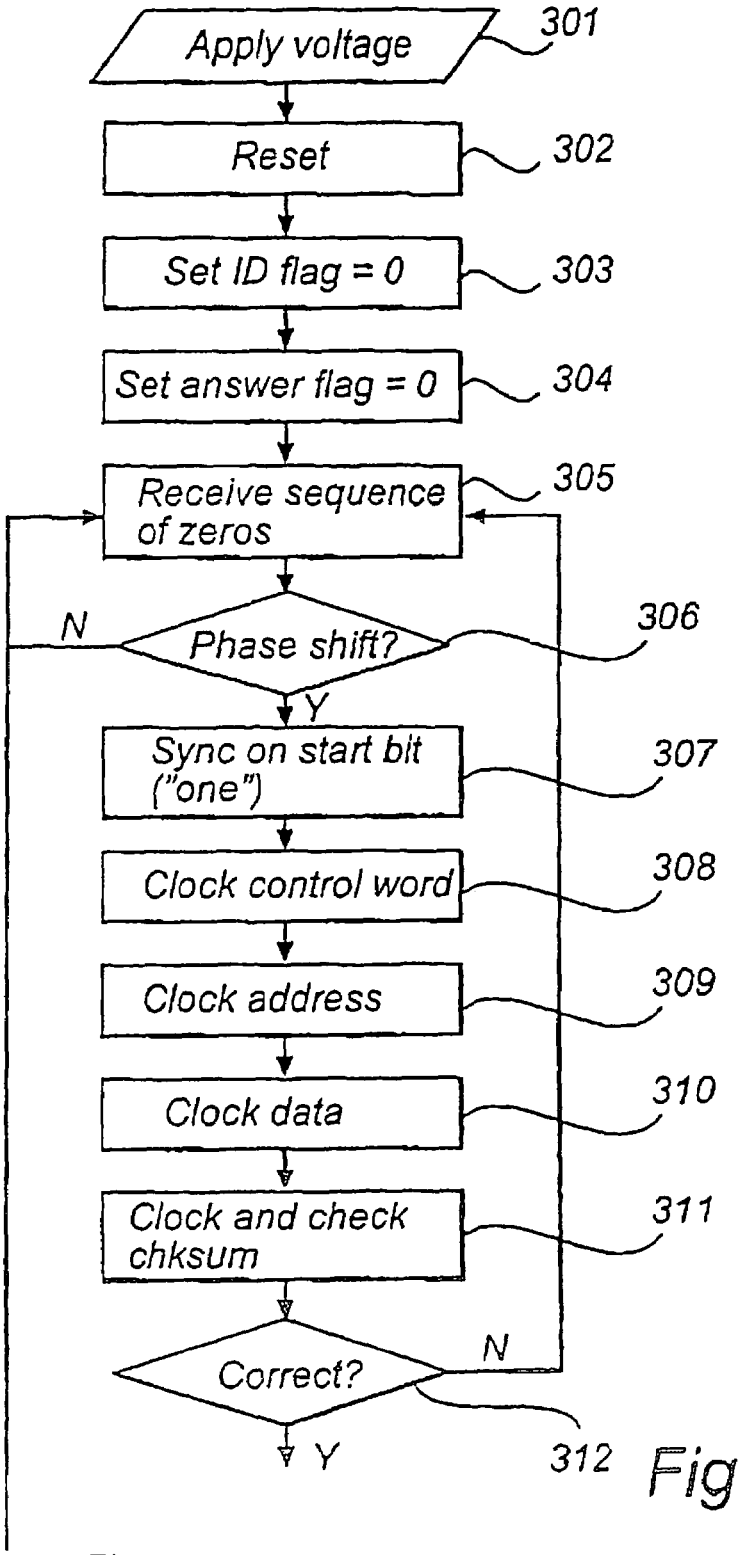
FIGS. 3*a* and 3*b* are schematic flow charts of activities passed through by the circuit device of the detonator when initiating (applying voltage) and receiving data packets.
Figure 3B:
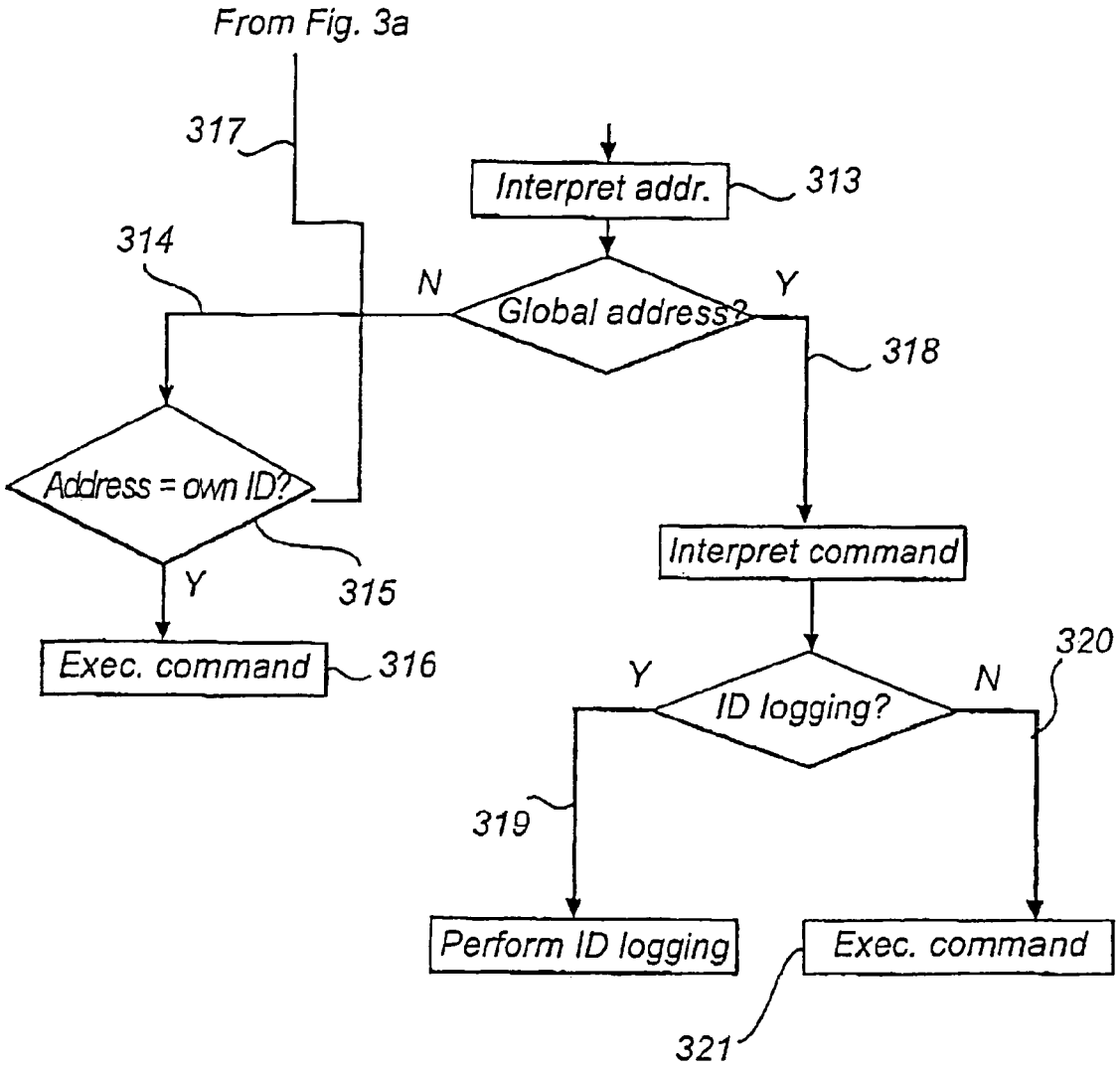

FIGS. 3*a* and 3*b* show schematic flow charts of the activities passed through by the circuitry of the detonator when applying the voltage and receiving a data packet. The first thing that happens after applying voltage 301 to the circuit device is that a resetting to the original values ("reset") is carried out 302. Subsequently, the flags IdAnsFlg and IdRcvFlg are both set to zero 303, 304, as an indication of the detonator neither answering questions regarding its identity nor being called individually (at a later stage these flags will, however, be reset).

The two flags IdAnsFlg and IdRcvFlg together form a two bit data word ("ID scanning word") which shows the state of the identity scanning (address scanning). The initial state for this data word is thus [0 0]. When scanning the address, it is this word which controls whether a detonator answers questions regarding its identity and whether a detonator has already been identified by the control unit.

The next step is that the detonator reads the digital data packet from the control unit. Initially, a sequence of zeroes is received 305, whereby the above-mentioned coarse calibration of the internal clock occurs in order to allow correct clocking of the data packet When a phase shift is detected 306, the reading is synchronised after the subsequent start bit (a one) 307. Subsequently, the control word 308, the address 309, the data bits 310 and the check sum 311 are clocked by turns. If the check sum is correct 312, the received command 313 is interpreted; if not, the detonator once again waits for a sequence of zeros.

When the received command is individual 314 and the address corresponds to the detonator's own address 315, the command which then has been received is carried out 316. If the address does not correspond to the detonator's own address, the detonator returns to the position where it reads a data packet 317 (i.e. it listens again for a sequence of zeros).

When the received command is global 318, this is carried out. If this command relates to address reading (ID logging) 319, and if the detonator at issue has not already answered questions regarding its address, the flag 'IdAnsFlg' is set to the value which indicates that the detonator answers the following questions regarding its address. If the detonator has already answered questions regarding its identity (its address), the command is ignored. In other respects, the reading of the address of the detonator occurs in accordance with that described earlier. If the global command is a different command 320 (i.e. does not relate to address reading), this command is carried out as usual 321.

Figure 4:
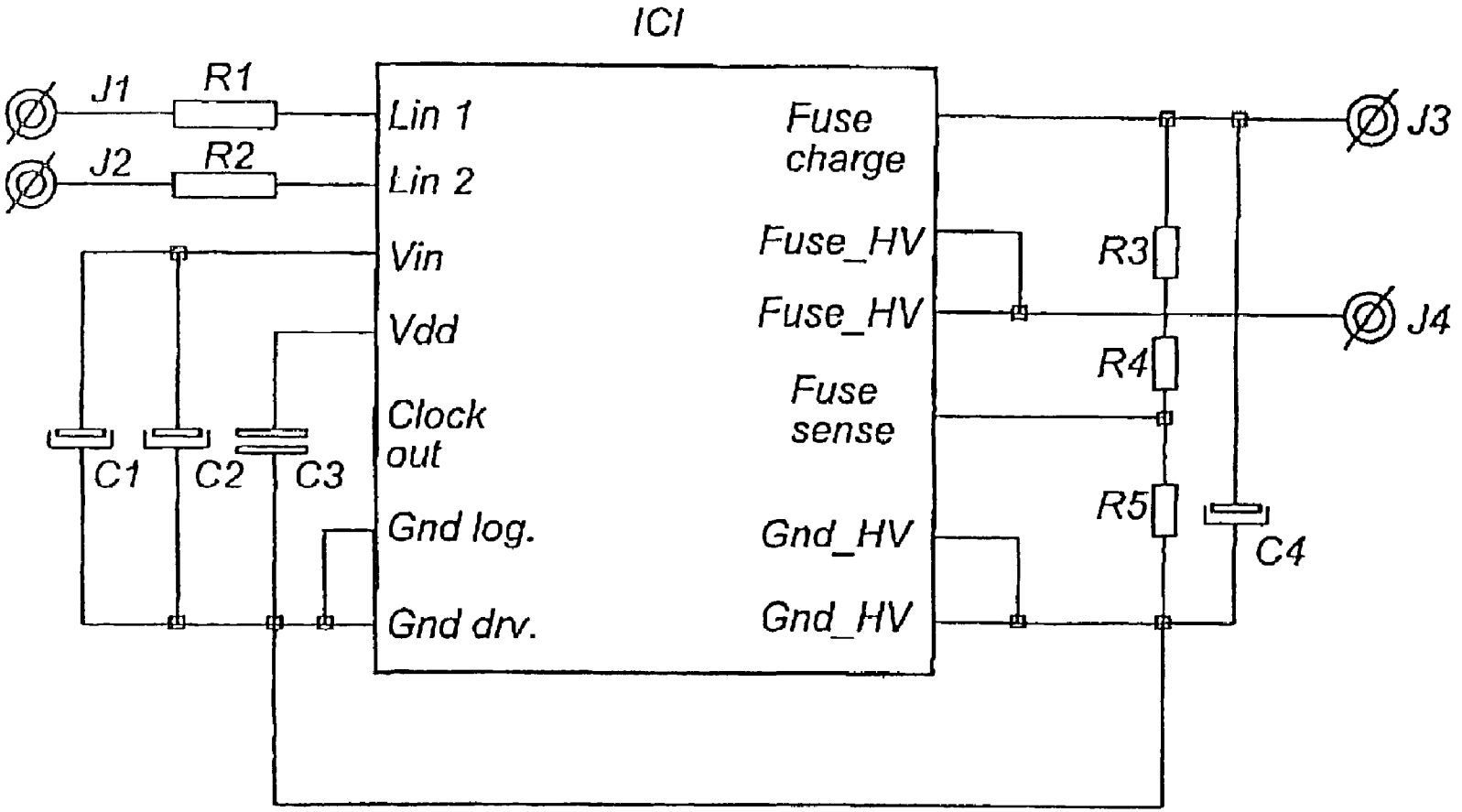
FIG. 4 is a schematic circuit diagram of the circuit device of the electronic detonator.

FIG. 4 shows a preferred embodiment of the electronic circuitry of the detonator. The functions of the detonator are implemented in an integrated circuit IC1.

The circuitry has two inputs Lin1, Lin2 with connecting pins J1, J2, which are used for current supply, as well as signalling. Two outer protecting resistors R1, R2 are connected to the respective connecting pins and provide current limitation/fuse function in the circuit device. In the preferred embodiment, these two resistors are 3.9 kohm each, Moreover, the circuit device has a fuse head TP with appositive pole J3 and a negative pole J4. Between the positive pole of the fuse head and its negative pole, the discharge occurs which leads to the detonator detonating.

Two supply capacitors C1, C2 are connected to the circuit IC1 between the input Vin and earth Gnd. These capacitors are charged as soon as the detonator is connected to a control unit (via the bus). The feed capacitors serve to drive the electronics of the detonator during the time the delay time is counted down (i.e. up to sixteen seconds) since there is a risk of the contact with the control unit being lost as a result of the blast. In the preferred embodiment, these feed capacitors are of 22 μF each.

A smoothing capacitor C3 is connected between the input Vdd and earth Gnd. It is preferred that the smoothing capacitor C3 has a capacitance of 0.47 μF.

Between the output Fuse_charge (the positive pole J3 of the fuse head TP) and earth, an ignition capacitor is connected. The ignition capacitor starts charging not until the command Arm has been received by the detonator. When the voltage across the ignition capacitor has achieved a predetermined value, the flag 'Arm_Flag' is set as an indication of the charging of the ignition capacitor having started. When the voltage is enough to a low firing, the flag 'HiVo_Flag' is set.

Bleeder resistors R3, R4, R5 are connected between the connections Fuse_charge, fuse_sense and earth Gnd. These resistors are used in combination for scanning the voltage of the ignition capacitor and for the bleeder function, i.e. for discharge of the ignition capacitor. It is preferred that the total resistance is about 15 Mohm.

Figure 5:
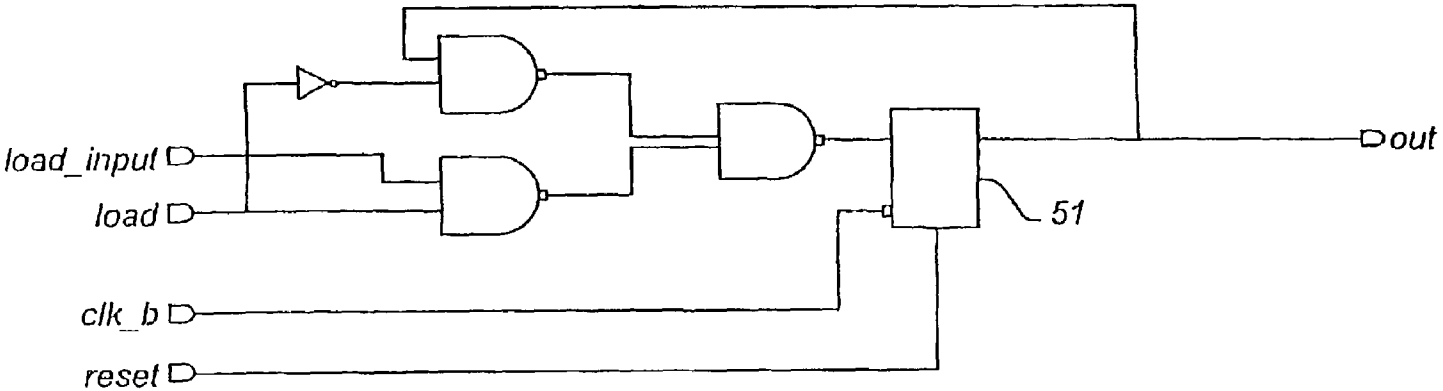
FIG. 5 is a schematic circuit diagram of an implementation of a general flag in an electronic detonator.

FIG. 5 shows a flow chart of an implementation of a general flag setting in the form of a status cell. The setting of flag occurs at the output OUT which is either high or low. The status cell has four inputs, i.e. load_input, load, clk_b and reset. The two entries load_input and load are connected to a predetermined internal scanning circuit (e.g., a circuit for sensing the voltage across the ignition capacitor) which is specific to the flag at issue. If a signal is given to these inputs, a flip-flop 51 will toggle at the next clock pulse which is given via the input clk_b to the flip-flop. The flip-flop 51 can be reset to its initial state by a signal on the reset input.

Figure 6:
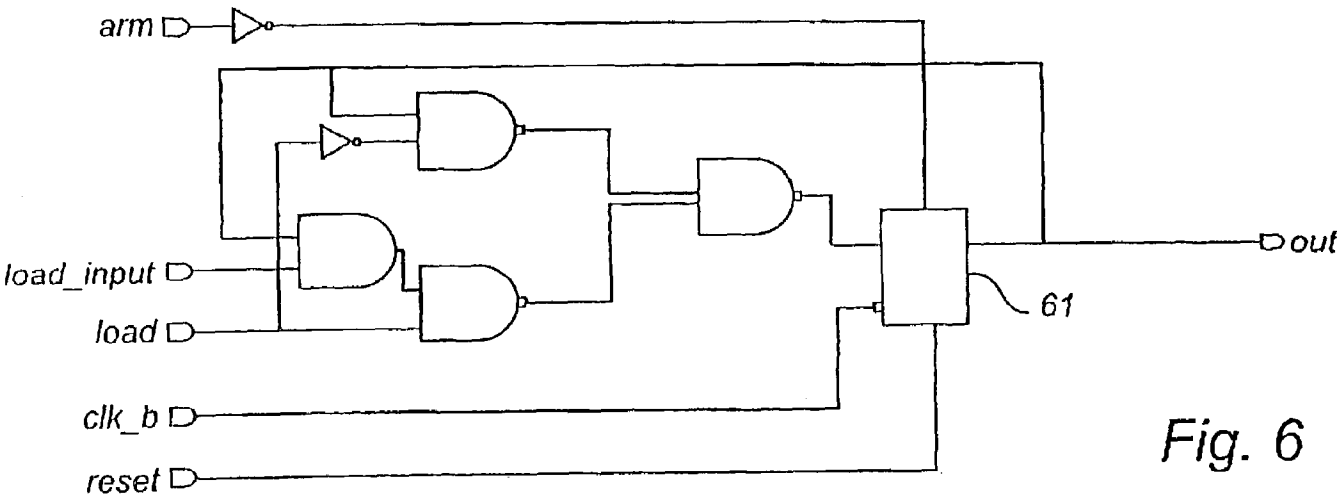
FIG. 6 is a schematic circuit diagram of an implementation of a certain flag in an electronic detonator.

FIG. 6 shows a circuit diagram of an implementation of a flag setting which also can be reset via a command from the external control unit. A flip-flop 61 for this type of flag setting has yet another input to which an externally controlled command is supplied. In the example shown in FIG. 6, the flag 'Arm_Flag' is involved, which, in accordance with that described above, may be implemented to be reset externally from the control unit by the 'Arm' command per se, as well as internally in response to the voltage across the ignition capacitor exceeding a predetermined value.

The invention claimed is:

1. A method for calibrating delay time in connection with firing an electronic detonator included in an electronic detonator system, in which an internal clock frequency in the electronic detonator is used when effecting the delay time and is calibrated in relation to an external clock frequency of a control unit, comprising in the electronic detonator the steps of:

extracting information about the external clock frequency from a digital data packet which is sent by the control unit to the electronic detonator, comparing the external clock frequency which is extracted from the digital data packet with the internal clock frequency of the electronic detonator in order to obtain a ratio of the external clock frequency to the internal clock frequency, using said ratio for calibration of the internal clock, and setting a first flag in the electronic detonator after completed calibration, the flag indicating that at least one calibration has been carried out and the flag being readable from the control unit by means of a digital data packet comprising a question regarding the state of said flag.

2. A method as claimed in claim 1, wherein the step of comparing the external clock frequency with the internal clock frequency comprises the steps of:

extracting external clock pulses from a digital data packet, each bit in the data packet corresponding to an external clock pulse, counting a predetermined number of external clock pulses by incrementing a first counter in the electronic detonator, counting simultaneously with the preceding step a number of internal clock pulses by incrementing a second counter in the electronic detonator, and comparing the external clock frequency with the internal clock frequency by comparing the numbers of pulses counted by the first and the second counter, respectively, whereby a said ratio of the external clock frequency to the internal clock frequency is obtained.

3. A method as claimed in claim 2 which also comprises the steps of:

receiving a signal in an electronic detonator, the signal comprising a delay time which is expressed in a general time format, storing said delay time in the detonator, determining a correction factor in the detonator on the basis of the ratio of the counted number of external clock pulses to the counted number of internal clock pulses, respectively, applying, In the detonator, said correction factor to the stored delay time In order to obtain an internal number of pulses which represents the number of internal clock cycles that corresponds to the delay time expressed in the general time format, and storing the internal number of pulses in the detonator, the thus stored, internal number of pulses representing the number of clock cycles which corresponds to the delay time received in the general time format.

4. A method as claimed in claim 3, further comprising the steps of:

before calibration setting a second flag in the electronic detonator, the second flag indicating that calibration is permitted in said detonator and the second flag being readable from the control unit by means of a digital data packet comprising a question regarding the state of said second flag, and setting a third flag in the electronic detonator as soon as said counting of clock pulses has been initiated, the third flag indicating that calibration of the electronic detonator at issue is in progress in parallel with other signalling and other events in the electronic detonator system and the third flag being readable from the control unit by means of a digital data packet comprising a question regarding the state of said third flag.

5. A method as claimed in claim 2, further comprising the steps of:

before calibration setting a second flag in the electronic detonator, the second flag indicating that calibration is permitted in said detonator and the second flag being readable from the control unit by means of a digital data packet comprising a question regarding the state of said second flag, and setting a third flag in the electronic detonator as soon as said counting of clock pulses has been initiated, the third flag indicating that calibration of the electronic detonator at issue is in progress in parallel with other signalling and other events in the electronic detonator system and the third flag being readable from the control unit by means of a digital data packet comprising a question regarding the state of said third flag.

6. A method as claimed in claim 1 which also comprises the steps of receiving a signal in an electronic detonator, the signal comprising a delay time which is expressed in a general time format, storing said delay time in the detonator, determining a correction factor in the detonator on the basis of the ratio of a counted number of external clock cycles to a counted number of internal clock cycles, respectively, applying, in the detonator, said correction factor to the stored delay time in order to obtain an internal number of pulses which represents the number of internal clock cycles that corresponds to the delay time expressed in the general time format, and storing the internal number of pulses in the detonator, the thus stored, internal number of pulses representing the number of clock cycles which corresponds to the delay time received in the general time format.

7. A method as claimed in claim 6, further comprising the steps of:

before calibration setting a second flag in the electronic detonator, the second flag indicating that calibration is permitted in said detonator and the second flag being readable from the control unit by means of a digital data packet comprising a question regarding the state of said second flag, and setting a third flag in the electronic detonator as soon as said counting of clock pulses has been initiated, the third flag indicating that calibration of the electronic detonator at issue is in progress in parallel with other signalling and other events in the electronic detonator system and the third flag being readable from the control unit by means of a digital data packet comprising a question regarding the state of said third flag.

8. A method as claimed in 1, further comprising the steps of:

before calibration setting a second flag in the electronic detonator, the second flag indicating that calibration is permitted in said detonator and the second flag being readable from the control unit by means of a digital data packet comprising a question regarding the state of said second flag, and setting a third flag in the electronic detonator as soon as said comparing of clock frequencies has been initiated, the third flag indicating that calibration of the electronic detonator at issue is in progress in parallel with other signalling and other events in the electronic detonator system and the third flag being readable from the control unit by means of a digital data packet comprising a question regarding the state of said third flag.

* * * * *